US008581740B2

(12) United States Patent
Hagen et al.

(10) Patent No.: US 8,581,740 B2
(45) Date of Patent: Nov. 12, 2013

(54) METHOD AND APPARATUS FOR COMMUNICATING SIGNALS TO AN INSTRUMENT IN A WELLBORE

(75) Inventors: Kelly W. Hagen, Sugar Land, TX (US); Kenneth R. Goodman, Richmond, TX (US); Dale W. Clinton, Sugar Land, TX (US); Feng Zhou, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 944 days.

(21) Appl. No.: 11/682,724

(22) Filed: Mar. 6, 2007

(65) Prior Publication Data

US 2008/0218374 A1 Sep. 11, 2008

(51) Int. Cl.
*G01V 3/00* (2006.01)

(52) U.S. Cl.
USPC ..... 340/853.1; 340/854.3; 166/64; 166/373; 166/381

(58) Field of Classification Search
USPC ..... 340/853.1, 854.3; 166/373, 381, 64
See application file for complete search history.

(56) References Cited

U.S. PATENT DOCUMENTS

| | | | | |
|---|---|---|---|---|
| 4,856,595 | A | 8/1989 | Upchurch | |
| 5,019,978 | A * | 5/1991 | Howard et al. | 702/6 |
| 5,113,379 | A | 5/1992 | Scherbatskoy | |
| 5,880,680 | A * | 3/1999 | Wisehart et al. | 340/853.4 |
| 6,035,880 | A * | 3/2000 | Gazda | 137/68.16 |
| 6,047,784 | A * | 4/2000 | Dorel | 175/61 |
| 6,116,344 | A * | 9/2000 | Longbottom et al. | 166/298 |
| 6,298,924 | B1 * | 10/2001 | Vaynshteyn et al. | 175/4.54 |
| 6,442,105 | B1 | 8/2002 | Tubel et al. | |
| 6,536,519 | B1 * | 3/2003 | Vaynshteyn et al. | 166/64 |
| 6,550,322 | B2 * | 4/2003 | Sweetland et al. | 73/152.51 |
| 6,847,304 | B1 * | 1/2005 | McLoughlin | 340/854.3 |
| 2005/0060096 | A1 * | 3/2005 | Hutchinson | 702/6 |
| 2005/0071120 | A1 * | 3/2005 | Hutchinson | 702/150 |
| 2006/0195265 | A1 * | 8/2006 | Schen et al. | 702/9 |
| 2006/0249045 | A1 | 11/2006 | Goodman et al. | |
| 2006/0266552 | A1 * | 11/2006 | Hutchinson | 175/50 |
| 2007/0007016 | A1 * | 1/2007 | Sanderlin | 166/381 |

FOREIGN PATENT DOCUMENTS

| | | | |
|---|---|---|---|
| EA | 007498 | B1 | 10/2006 |
| GB | 2288834 | A | 11/1995 |
| GB | 2368081 | | 2/2002 |
| GB | 2422698 | | 8/2006 |
| RU | 26087 | U1 | 11/2002 |
| RU | 2204712 | C2 | 5/2003 |
| RU | 2273732 | C2 | 4/2006 |
| RU | 2289690 | C2 | 12/2006 |
| SU | 1298361 | A1 | 3/1987 |

OTHER PUBLICATIONS

English Translation of Russian Decision to Grant for RU Application No. 2008108716/03 dated Mar. 5, 2012.

* cited by examiner

*Primary Examiner* — Tai T Nguyen
*Assistant Examiner* — Amine Benlagsir
(74) *Attorney, Agent, or Firm* — Kenneth Liu

(57) ABSTRACT

A method for communicating a signal to an instrument in a wellbore includes axially accelerating the instrument in a preselected pattern of acceleration. The predetermined pattern corresponds to the signal to be communicated. The axial acceleration of the instrument is detected, and the signal is decoded from the detected axial acceleration. A signal detection system for an instrument in a wellbore includes an accelerometer oriented along a longitudinal axis of the instrument and means for comparing measurements made by the accelerometer to at least one predetermined pattern.

20 Claims, 3 Drawing Sheets

FIG.3
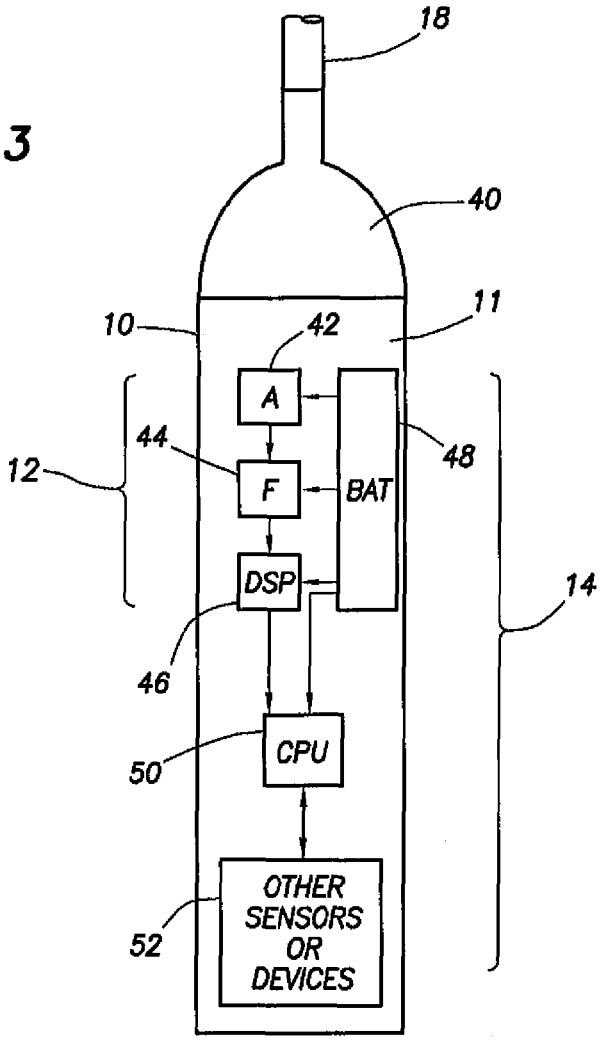
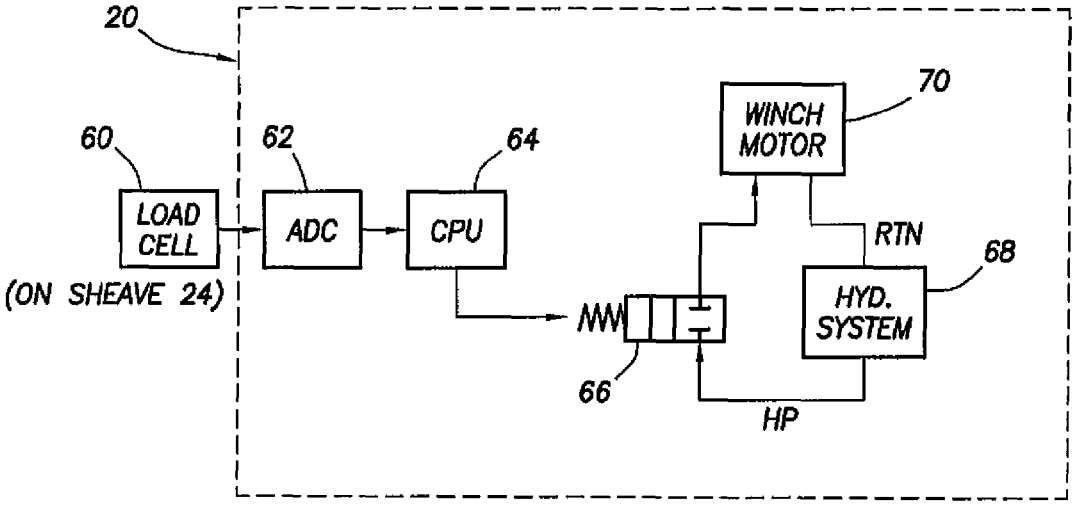
FIG.4

METHOD AND APPARATUS FOR COMMUNICATING SIGNALS TO AN INSTRUMENT IN A WELLBORE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of instrumentation used in wellbores drilled through Earth formations. More specifically, the invention relates to methods and apparatus for communicating signals to an instrument in a wellbore from the Earth's surface.

2. Background Art

Instruments used in wellbores drilled into the Earth's subsurface include a wide variety of sensing devices and mechanical operating devices. Examples of the former include pressure and temperature sensors, inclinometers and directional sensors, capacitance sensors, fluid density sensors, among others. In using such instruments, it is often necessary to send signals from the Earth's surface to the instrument to affect instrument operation or to provide information that may be used in the instrument.

For instruments deployed in a wellbore using armored electrical cable ("wireline" deployment) signals are transmitted along the cable to the instrument from the surface, typically from a surface recording system. For instruments deployed using a drilling rig or similar apparatus, where the instrument may be conveyed at the end of a drill pipe or tubing string, it is known in the art to send signals to the instrument by modulating the flow of drilling fluid through the drill pipe. Such modulation may be detected and decoded at the instrument by a flow sensor or a pressure sensor. It is also known in the art to send signals to the instrument by modulating the rate of rotation of the drill pipe. See, for example, U.S. Pat. No. 6,847,304 issued to McLoughlin and U.S. Pat. No. 5,113,379 issued to Scherbatskoy. It is also known in the art to communicated signals to an instrument in a wellbore by modulating fluid pressure from the Earth's surface. See, for example U.S. Pat. No. 4,856,595 issued to Upchurch and assigned to the assignee of the present invention.

In some cases, it is impractical to use any of the foregoing techniques for communicating signals to an instrument in a wellbore. For example, using "slickline" (a solid wire or wire rope conveyance having no insulated electrical conductors) there is no practical way to send electrical signals to the instrument from the Earth's surface. Further, it is not possible to rotate an instrument from the surface when conveyed by slickline or by coiled tubing. Finally, some wellbore instruments are materially complicated as to design by including a pressure or flow sensor.

SUMMARY OF THE INVENTION

One aspect of the invention is a method for communicating a signal to an instrument in a wellbore. A method according to this aspect of the invention includes axially accelerating the instrument in a preselected pattern of acceleration. The predetermined pattern corresponds to the signal to be communicated. The axial acceleration of the instrument is detected, and the signal is decoded from the detected axial acceleration.

A signal detection system for an instrument in a wellbore according to another aspect of the invention includes an accelerometer oriented along a longitudinal axis of the instrument. The system also includes means for comparing measurements made by the accelerometer to at least one predetermined pattern. The predetermined pattern corresponds to a signal communicated from the Earth's surface to the instrument.

Other aspects and advantages of the invention will be apparent from the following description and the appended claims.

BRIEF DESCRIPTION OF THE DRAWINGS

FIG. 3 shows more detail of acceleration detection and sensor components of the instruments shown in FIGS. 1 and 2.

FIG. 4 shows one example of an automatic system for generating signals for communicating to an instrument in a wellbore.

DETAILED DESCRIPTION

Figure 1:
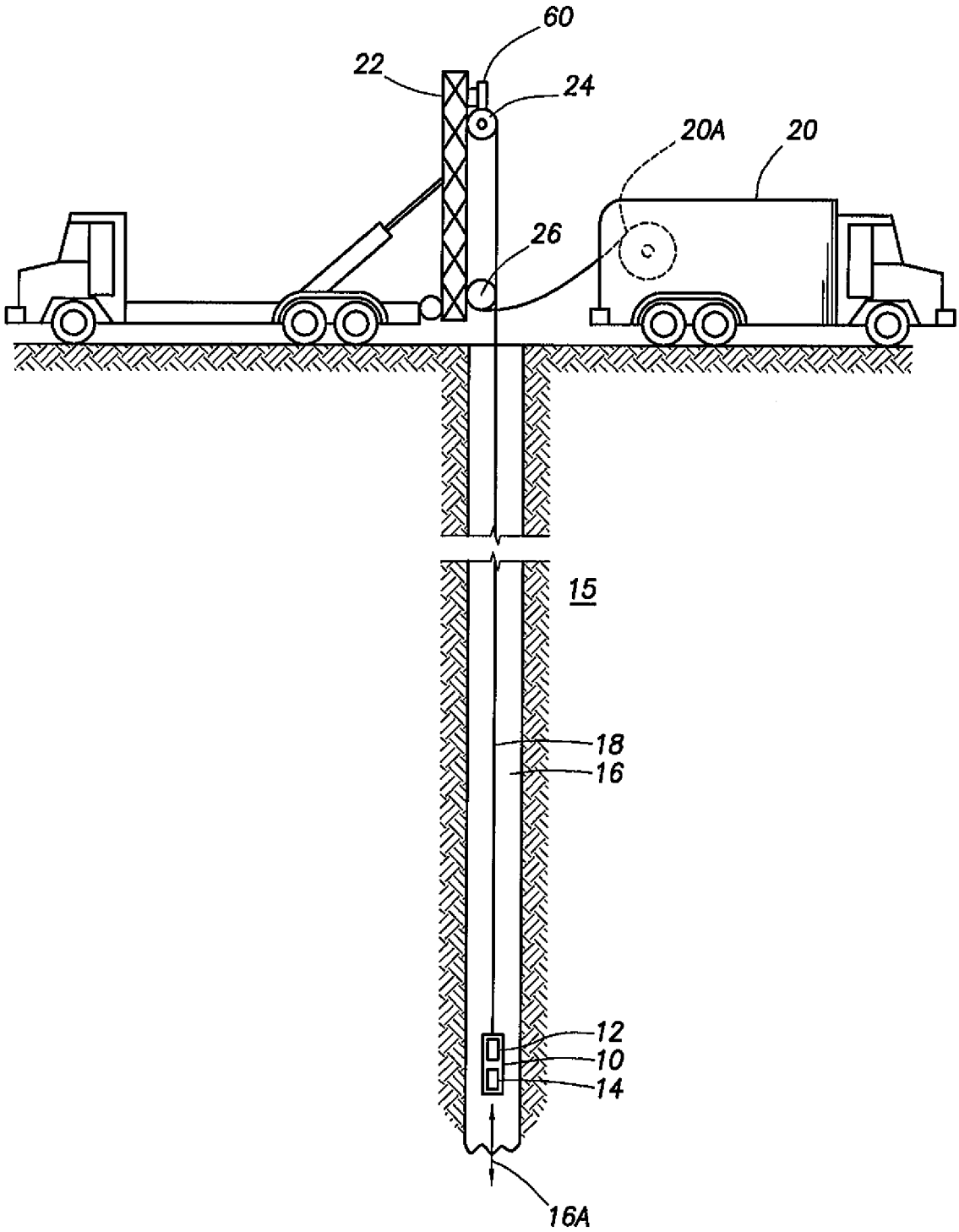
FIG. 1 shows an instrument deployed in a wellbore by a slickline unit.

FIG. 1 shows an example of a wellbore instrument 10 having signal detection and decoding devices according to one aspect of the invention as it may be deployed in a wellbore using a conveyance device known as a "slickline unit", shown generally at 20 in FIG. 1. "Slickline" is generally known in the art as a solid steel wire or wire rope deployed form a winch or similar spooling device to deploy or withdraw various instruments from a wellbore, and the term slicking unit includes such wire or wire rope, the winch and associated winch control devices. The present description of the invention is in terms of certain example conveyance devices, wherein the term conveyance device is intended to mean any device known in the art for inserting instruments into and removing instruments from a wellbore drilled through the Earth's subsurface. Such conveyance devices include slickline units and coiled tubing units as set forth in this description, because those conveyance devices represent particularly appropriate uses for a system and method according to the invention. It should be clearly understood, however, that any other conveyance device known in the art, including a drilling rig having a hoisting system, a workover rig having similar hoisting system that can convey devices into and out of a well using threadedly coupled segments of tubing or pipe, or a "wireline" unit having a winch that spools armored electrical cable having one or more insulated electrical conductors therein may also be used with the invention. Accordingly, the example conveyance devices shown herein are only meant to illustrate the general principle and are not intended to limit the scope of this invention.

The slickline unit 20 includes a winch 20A or similar device of any type known in the art. As will be further explained with reference to FIG. 4, the winch 20A may be rotated by a motor (not shown in FIG. 1) or similar source of rotary motive power Slickline 18 is shown deployed from the slickline unit 20 into a wellbore 16 drilled through the Earth's subsurface. In FIG. 1, the slickline 18 is routed through an upper sheave 24 and lower sheave 26 of types well known in the art. The sheaves 26, 24 redirect the slickline 18 so that it extends vertically over the wellbore 16 for extension therein and withdrawal therefrom. The sheaves 24, 26 may be supported by a portable mast unit 22 of any type well known in the art.

The instrument 10 is shown deployed in the wellbore 16 at the lower end of the slickline 18. The instrument 10 may include sensors or other devices and a data acquisition processor, shown generally at 14, and an accelerometer and associated signal processing circuit devices, shown generally at 12. The accelerometer 12 is oriented in the instrument 10 to be sensitive primarily to acceleration along the longitudinal axis of the instrument, as shown generally by line 16A.

A tensile stress sensing element, or "load cell" 60 may be coupled between the upper sheave 24 and the derrick portion of the mast unit 22 to enable estimating the tensile stress ("weight") on the slickline 18. In addition to providing the slickline unit 20 operator with indication of the condition of the instrument 10 as it is moved along the wellbore 16, tensile stress measurements may be used, as will be explained below with reference to FIG. 4, to assist in operating the winch 20A so as to generate a signal for communication from the Earth's surface to the instrument 10 in the wellbore 16.

Figure 2:
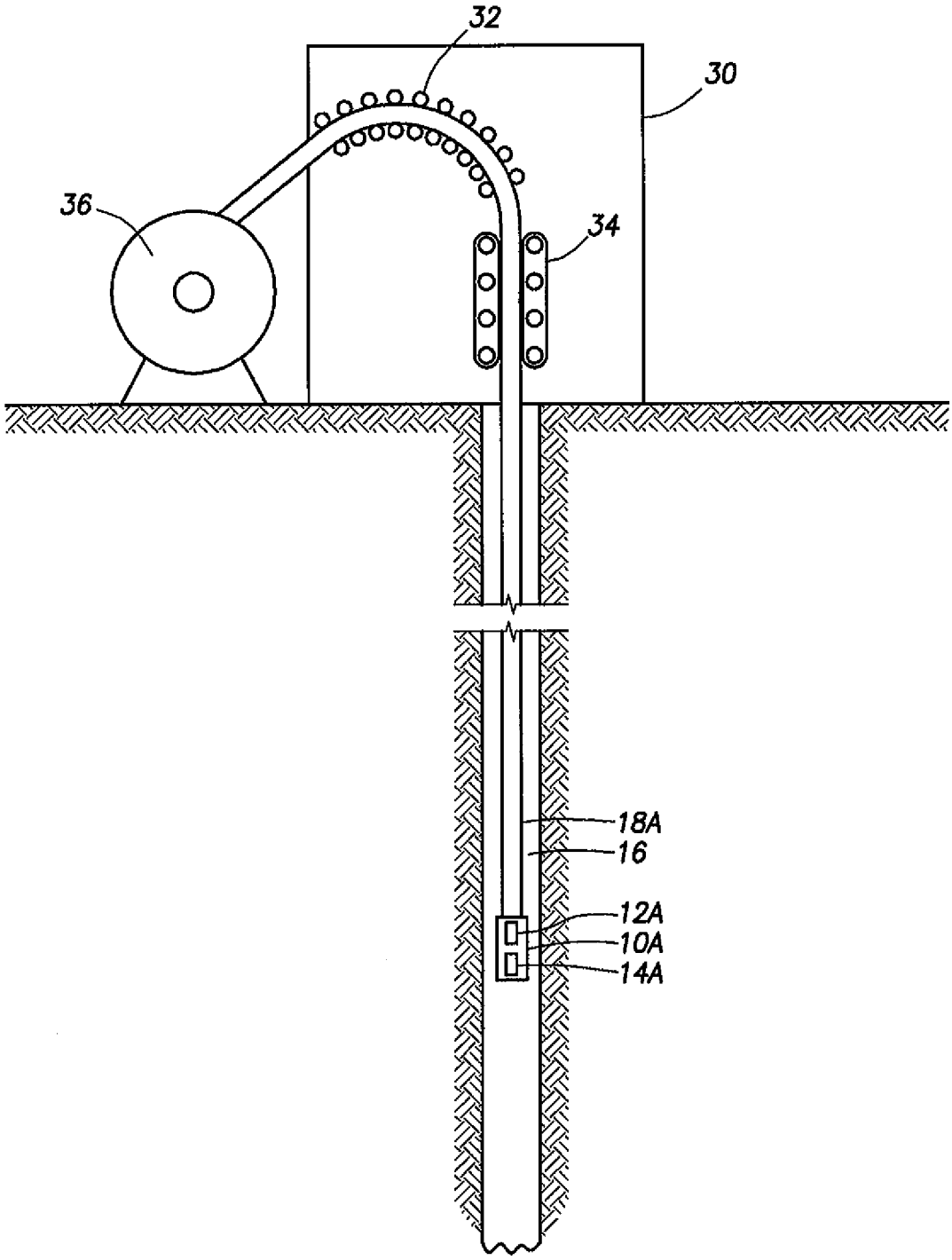
FIG. 2 shows an instrument deployed in a wellbore by a coiled tubing unit.

Another example of deployment device for a wellbore instrument is shown in FIG. 2. The deployment device shown in FIG. 2 is a coiled tubing unit 30. Coiled tubing 18A is stored on a reel 36. The coiled tubing 18A can be extended into the wellbore 16 and withdrawn from the wellbore 16 to move the instrument 10. The coiled tubing unit 30 typically includes a tractor device called an "injector head", shown generally at 34. The injector head 34 includes tractor belts or similar devices that move the coiled tubing 18A upwardly and downwardly. The coiled tubing 18A is redirected from the reel 36 to a generally vertical orientation over the injector head 34 using a device called a "gooseneck", shown generally at 32 and which typically includes a plurality of rollers disposed along an arcuate path in a support structure. Although not shown separately in FIG. 2, typically the coiled tubing unit 30 will include a weight indicator or load cell similar in purpose to the load cell 60 shown in FIG. 1 as used with the slickline unit (20 in FIG. 1).

The deployment devices shown in FIG. 1 and FIG. 2 are only examples of deployment devices that may be used with a method and apparatus according to the invention, as explained above. The devices shown in FIG. 1 and FIG. 2 are those for which the invention is intended because both do not necessarily include an electrical signal channel, optical signal channel or pressure signal channel to communicate a signal from the Earth's surface to the instrument in the wellbore, neither can they readily cause the instrument to rotate in the wellbore.

Having shown generally conveyance devices for deploying the instrument in the wellbore, an example of a signal detection and decoding apparatus according to one aspect of the invention will be explained with reference to FIG. 3. The instrument 10 may include an elongated housing 11 configured to move along the interior of the wellbore. The housing 11 typically defines a sealed interior chamber therein. The housing 11 maybe coupled to the end of the slickline 18 (or coiled tubing 18A) by means of a cable head 40 of any type known in the art for coupling a slickline instrument thereto. Devices for signal acquisition and processing are typically disposed in such sealed chamber.

The signal detection and processing device 12 may include an accelerometer 42, such as a quartz flexure accelerometer, as previously explained, oriented so that its sensitive axis is generally along the longitudinal axis (16A in FIG. 1) of the instrument 10. One such accelerometer is sold under model designation QAT160 by Honeywell International, 101 Columbia Rd., Morristown, NJ 07960. So arranged, the accelerometer 42 will generate a signal related to the axial acceleration on the instrument 10. Output of the accelerometer 42 may be coupled to an operational amplifier, single pole bandpass filter combination 44 ("filter"), which may condition the accelerometer 42 output and filter acceleration components above and/or below a selected frequency. In one example, the filter 44 has a high cut frequency of about 50 Hz. Output of the filter 44 may be conducted to a digital signal processor ("DSP") 46. The DSP 46 may include an internal analog to digital converter ("ADC") or may use a separate ADC (not shown) coupled between the output of the filter 44 and the input of the DSP 46. One suitable DSP is sold under model designation TMS320C33 by Texas Instruments Inc., 12500 TI Boulevard, Dallas, TX 75243-4136.

The other signal acquisition and processing devices 14 may include a central processor 50 to process and/or record signals output from the DSP 46 as well as signals generated by one or more other sensors 52 or other devices in the instrument 10. Non-limiting examples of such other sensors 52 may include pressure and/or temperature sensors and calipers (wellbore internal diameter measuring devices). Any other device ordinarily operated by a slickline or coiled tubing conveyed instrument may also be disposed in or associated with the housing 11. Accordingly, the structure shown in FIG. 3 is not intended to limit the scope of the types of other sensors or devices that may be used in the instrument 10.

Electrical power to operate all the foregoing devices may be supplied by a battery 48 or other energy storage device. The source of electrical power to operate the various devices in the instrument, however, is not intended to limit the scope of this invention.

In one example, the DSP 46 may be configured to measure the filtered output of the accelerometer 42 for a selected period of time, for example, by buffering a selected number of accelerometer measurement samples, and calculating certain attributes of the measured acceleration. Such attributes may include maximum acceleration, minimum acceleration, means acceleration and variance (or standard deviation). The statistical information may be used in some examples to discriminate between true signals communicated from the Earth's surface and noise that is unlikely to represent a signal from the Earth's surface. For example, if the maximum and minimum acceleration values within a selected time interval are not outside selected threshold criteria, the measured acceleration may be attributed to ordinary operation of the conveyance device rather than signal elements.

The DSP 46 may be configured to compare the measured acceleration to one or more predetermined acceleration patterns. If a predetermined acceleration pattern is matched, the DSP 46 may communicate a signal to the processor 50 corresponding to the detected pattern indicating that a signal has been detected. The processor 50 may operate one or more devices in the instrument 10 according to instructions corresponding to the detected signal. For example, a sensor may be switched on or off. A recording device in the processor 50 may be switched to record a particular type of sensor output or change a sample rate of sensor signal recording. It is not a limit on the scope of this invention as to the type of operation initiated (or stopped) by the instrument 10 in response to a detected pattern. In addition, while the foregoing examples of signals from the Earth's surface have been explained in terms of commands or instructions, it is also within the scope of this invention that data may also be communicated to the instrument. Accordingly, the term "signal" as used herein with reference to information being transmitted from the Earth's surface to the instrument is intended to mean any information that can be encoded into a particular acceleration pattern and detected by suitable processing of acceleration signals in the DSP 46 and/or processor 50, or any similar signal detection and decoding device.

Acceleration as that term is used in the present description is intended to mean a force applied for a sufficient duration of time so as to change the velocity of the instrument 10. Such definition is intended to distinguish from acoustic signal transmission (which may be detected by an accelerometer), in which elastic or shear waves are moved through the instrument 10 but do not change its velocity.

To generate a selected acceleration pattern at the Earth's surface to represent a signal to be communicated to the instrument 10, the winch (20A in FIG. 1) or the coiled tubing unit (30 in FIG. 2) may be operated to accelerate the instrument in a predetermined manner. For example, the winch or coiled tubing unit may be operated to momentarily apply upward motion to the slickline (18 in FIG. 1) or coiled tubing (18A in FIG. 2), momentarily stop the slickline or tubing, and repeat the foregoing for a selected number of accelerate/stop operations. As another example, the foregoing upward acceleration/stopping sequences may be followed by a selected duration waiting period, followed by another selected number of upward acceleration/stop sequences. Downward acceleration and/or acceleration and stopping sequences may also be used.

In one example, the slickline unit or coiled tubing unit operator may cause the upward (or downward) motion to generate a selected increase (or decrease) in measured tensile stress (as measured by the load cell 60 in FIG. 1) over the tensile stress measured while the instrument is stationary in the wellbore. Such increase in tensile stress will be related to acceleration of the slickline or coiled tubing, and consequently, will be related to the acceleration applied to the instrument 10. By selecting a predetermined tensile stress increase ("overpull"), the acceleration applied to the instrument 10 is more likely to be detected as part of a signal sequence, rather than ordinary operation of the slickline or coiled tubing unit for moving the instrument.

In another example, automatic operation of the slickline or coiled tubing unit for signal generation may be provided by an apparatus such as the one shown in FIG. 4. The components shown in FIG. 4, other than the load cell 60 may be associated with or disposed in the coiled tubing unit (30 in FIG. 2) or the slickline unit 20 as shown. A central processor 64 such as a microprocessor based controller or programmable logic controller (PLC) may include program code intended to operate the slickline winch (or coiled tubing winch) in a predetermined sequence of start/stop operations in order to communicate a signal from the Earth's surface to an instrument in the wellbore. When an appropriate input signal is provided to the central processor 64 by the system operator, the central processor 64 can apply electrical power to actuate a solenoid-operated hydraulic valve 66. The valve 66 may be included in an hydraulic system 68 functionally associated with an hydraulic motor 70. The motor 70 provides the motive power to drive the winch (20A in FIG. 2). When oriented, the solenoid valve 66 will cause the motor 70 to start and stop. The central processor 64 may accept input signals from the load cell 60, suitably digitized in an analog to digital converter 62. The central processor 64 may be programmed to operate the valve 66 start the motor 70 until a preselected increase in detected stress is measured by the load cell 60, and then operate the valve 66 to stop the motor 70. Such process may continue for a preselected number of cycles until the selected signal is communicated to the instrument (10 in FIG. 1).

The example system shown in FIG. 4 may be applied to the coiled tubing unit as well. Although the example shown in FIG. 4 provides electrical control of an hydraulic motor, those skilled in the art will appreciate that an electric motor or a prime mover may also be controlled by a similar system.

Alternatively, an as explained above, the winch or coiled tubing unit may be operated to momentarily move the instrument downward at full speed and then stop motion of the instrument. The winch or coiled tubing unit may also be operated to move the instrument downward and then reverse motion, either prior to stopping motion of subsequent reversing the direction of motion of the instrument.

By operations such as suggested above, a signal may be transmitted from the Earth's surface to the instrument in the wellbore without the need for a directly coupled signal communication channel (e.g., electrical power, optical signal or pressure modulation).

While the invention has been described with respect to a limited number of embodiments, these skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for communicating a signal to an instrument in an environment, comprising:

axially accelerating the instrument in a preselected pattern of acceleration, the predetermined pattern corresponding to the signal to be communicated;

detecting the axial acceleration of the instrument using an accelerometer;

decoding the signal from the detected axial acceleration, wherein the decoding of the signal comprises using a digital signal processing device to measure a filtered output of the accelerometer over a selected period of time, buffering each of a plurality of measurement samples obtained during the selected period of time, and then calculating at least one of maximum acceleration, minimum acceleration, variance of acceleration, or standard deviation of acceleration for measured acceleration during a selected time period based at least partially on the buffered measurement samples;

comparing statistical information comprising the at least one of maximum acceleration, minimum acceleration, variance of acceleration, or standard deviation of acceleration for measured acceleration during a selected time period to a selected threshold criteria;

attributing the measured acceleration to ordinary operation of a conveyance device conveying the instrument if the statistical information is within the threshold criteria; and attributing the measured acceleration to the signal if the statistical information is outside the threshold criteria.

2. The method of claim 1 wherein the axially accelerating comprises operating a cable winch.

3. The method of claim 1 wherein the axially accelerating comprises operating a coiled tubing unit.

4. The method of claim 1 wherein the predetermined pattern comprises upward acceleration and stopping the instrument upward motion, and repeating the upward acceleration and stopping for a predetermined number of times.

5. The method of claim 1 wherein an amount of axial acceleration is determined by measuring a change in tensile stress applied to at least one of a cable and a tubing used to convey the instrument into the environment.

6. The method of claim 1 wherein the predetermined pattern comprises downward acceleration and stopping the instrument downward motion, and repeating the downward acceleration and stopping for a predetermined number of times.

7. The method of claim 1, wherein the predetermined pattern comprises upward acceleration.

8. The method of claim 1, wherein the decoding comprises calculating minimum acceleration and maximum acceleration for measured acceleration during the selected time period.

9. The method of claim 8, further comprising:

comparing the minimum acceleration and the maximum acceleration for measured acceleration during the selected time period to a selected threshold criteria;

attributing the measured acceleration to ordinary operation of a conveyance device conveying the instrument if the minimum acceleration and the maximum acceleration are within the threshold criteria; and attributing the measured acceleration to the signal if the at least one of the minimum acceleration and the maximum acceleration is outside the threshold criteria.

10. A signal detection system for an instrument in an environment, comprising:

an accelerometer oriented along a longitudinal axis of the instrument;

a digital filter operative to filter an output of the accelerometer; and a processing device configured to compare measurements made by the accelerometer to at least one predetermined pattern corresponding to a signal communicated from the Earth's surface to the instrument by:

measuring over a selected time interval a filtered output signal from the accelerometer;

buffering each of a plurality of samples from the filtered output signal obtained during the selected time interval;

calculating at least one of maximum measured acceleration, minimum measured acceleration, variance of measured acceleration or standard deviation of measured acceleration for measured acceleration during the selected time interval based at least partially upon the buffered samples;

comparing statistical information comprising the at least one of maximum acceleration, minimum acceleration, variance of acceleration or standard deviation of acceleration for measured acceleration during the selected time interval to a selected threshold criteria;

attributing the measured acceleration to ordinary operation of a conveyance device conveying the instrument if the statistical information is within the threshold criteria; and attributing the measured acceleration to the signal if the statistical information is outside the threshold criteria.

11. The system of claim 10 further comprising a conveyance device located at the Earth's surface that is configured to apply acceleration in a predetermined pattern to the instrument in the environment.

12. The system of claim 11 wherein the conveyance device comprises a controller in functional communication with a motor configured to supply motive power to the conveyance device, and a tensile stress sensor arranged to measure tensile stress on at least one of a cable, a wire and a tubing coupled between the conveyance device and the instrument.

13. The system of claim 12 wherein the motor comprises an hydraulic motor.

14. The system of claim 12 wherein the motor comprises an electric motor.

15. The system of claim 12 wherein the controller is configured to operate the motor until a preselected overpull is detected by the tensile stress sensor.

16. The system of claim 10, wherein the digital filter is a high-pass filter having a cut off frequency of approximately 50 hertz.

17. A system for communicating a command signal to an instrument disposed in a wellbore comprising:

a conveyance device located generally at the Earth's surface and being coupled to the instrument by a conveyance channel that does not comprise an electrical conductor, the conveyance device comprising a first processing device, a hydraulic valve, a hydraulic motor operative in response to the hydraulic valve, wherein the first processing device operates the motor to apply a predetermined sequence of start and stop operations to the conveyance channel to communicate the command signal to the instrument, wherein applying a predetermined acceleration of start and stop operations comprises at least one of generating a predetermined increase in tensile stress that differs from the tensile stress measured while the instrument is stationary within the wellbore;

an accelerometer oriented along a longitudinal axis of movement of the instrument; and a second processing device disposed within the instrument and which compares data samples acquired by the accelerometer to at least one predetermined pattern corresponding to the command signal communicated from the conveyance device to the instrument by:

measuring filtered data samples from the accelerometer acquired during a predetermined time interval;

buffering each of a plurality of filtered data samples obtained during the predetermined time interval;

calculating at least one of variance of measured acceleration or standard deviation of measured acceleration for measured acceleration during the selected time interval based at least partially upon the buffered data samples;

comparing statistical information comprising the at least one of variance of acceleration or standard deviation of acceleration for measured acceleration during the predetermined time interval to a selected threshold criteria; and attributing the measured acceleration to ordinary conveyance of the instrument if the statistical information is within the threshold criteria and to receiving of the command signal it the statistical information is outside the threshold criteria.

18. The system of claim 17, wherein the hydraulic valve comprises a solenoid-operated hydraulic valve that is actuated in responsive to electrical power to control the hydraulic motor.

19. The system of claim 17, wherein the predetermined increase in tensile stress applied by the conveyance device enhances the likelihood that the predetermined acceleration sequence will be identified as the command signal rather than ordinary operation of the conveyance device for moving the instrument.

20. The system of claim 17, wherein the second processing device switches a sensor of the instrument on or off responsive to the command signal.

* * * * *